US007834285B2

(12) United States Patent
Hsu

(10) Patent No.: US 7,834,285 B2
(45) Date of Patent: Nov. 16, 2010

(54) KEYPAD ASSEMBLY

(75) Inventor: Chih-Ho Hsu, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 659 days.

(21) Appl. No.: 11/741,901

(22) Filed: Apr. 30, 2007

(65) Prior Publication Data

US 2008/0223702 A1 Sep. 18, 2008

(30) Foreign Application Priority Data

Mar. 14, 2007 (TW) ..... 96108814 A

(51) Int. Cl.
*H01H 13/04* (2006.01)
*H01H 19/04* (2006.01)

(52) U.S. Cl. ..... 200/333; 200/308

(58) Field of Classification Search ..... 200/333
See application file for complete search history.

(56) References Cited

U.S. PATENT DOCUMENTS 7,449,642 B1 * 11/2008 Wu et al. ..... 200/5 A
7,523,544 B2 * 4/2009 Hsu ..... 29/622
7,626,133 B2 * 12/2009 Wu et al. ..... 200/341
2007/0295588 A1 * 12/2007 Kamata ..... 200/341

FOREIGN PATENT DOCUMENTS

TW M301397 11/2006
TW M304441 1/2007

* cited by examiner

*Primary Examiner*—Renee S Luebke
*Assistant Examiner*—Lheiren Mae A Caroc
(74) *Attorney, Agent, or Firm*—Chun-Ming Shih; HDLS IPR Services

(57) ABSTRACT

A compact keypad structure includes a keypad panel with a smooth face, matted face or patterned layer. The keypad structure includes a flexible printed circuit board, an illumination layer, a resilient layer and a keypad layer in bottom-up order. The illumination layer includes an illumination plate to illuminate the bottom of the resilient body when the keypad is operated. Therefore, the surface of the keypad has a transparent effect for display. The first carrier and the second carrier of the keypad layer, and the resilient body of the resilient layer are deformed when an external force is applied to the surface of the keypad. A protrusion is pressed against the surface of the illumination plate and a metal dome on another face of the illumination plate is deformed and pressed against the flexible printed circuit board. The metal dome is in contact with a contact of the flexible printed circuit board to output an operation signal.

15 Claims, 18 Drawing Sheets

KEYPAD ASSEMBLY

FIELD OF THE INVENTION

The present invention relates to a keypad structure, especially to a compact keypad structure.

DESCRIPTION OF PRIOR ART

The users of mobile phones generally consider the appearance and compact size of the mobile phones besides the functions of the mobile phones. Therefore, certain mobile phones are printed with colorful pattern on the casing and keypad thereof to enhance added-on value and purchase desire. Moreover, to this end, three-dimension pattern can be formed on the casing.

Taiwan patent gazette No. M304441 discloses a prior three-dimension pattern. With reference to FIG. 1A, this prior art comprises a base 1*a*, a first transparent layer 2*a* on the base 1*a*, a first color layer 3*a* and color opening area 31*a* on the first transparent layer 2*a*. A second transparent layer 4*a* is on the first color layer 3*a* and a second color layer 5*a* is attached to the second transparent layer 4*a*. By this structure, the keypad product has colorful and textual appearance with different depth of fields, thus rendering various visual effects to the keypad. However, the method for manufacturing the prior art three-dimension pattern is time and labor consuming and cost is increased.

Taiwan patent gazette No. M301397 discloses another prior pattern formed in keypad structure. With reference to FIG. 1B, a pattern layer 1*b* is sandwiched between a membrane layer 2*b* and a resilient layer 3*b* to provide light-glaring effect. However, because the pattern layer 1*b* is sandwiched between the membrane layer 2*b* and the resilient layer 3*b*, the manufacture is complicated and time consuming. The thickness of keypad is increased and it is undesirable for compact keypad.

SUMMARY OF THE INVENTION

It is an object of the present invention to provide a compact keypad, wherein smooth face, matted face or patterned layer is directly formed on the surface of keypad panel and keycap surface. Therefore, the thickness of the keypad is not increased; the manufacturing procedures and time are also saved.

Accordingly, the present invention provides a compact keypad structure comprising:

a flexible printed circuit board being a thin-film printed circuit board formed with circuit traces and contacts;

an illumination layer comprising illumination plate on the flexible printed circuit board, where the illumination plate can be an electroluminescent panel and comprises a plurality of metal domes on another face thereof, the metal domes are corresponding to the contacts of the flexible printed circuit board;

a resilient layer arranged on the illumination layer and comprising a second carrier and a resilient body arranged on one face of the second carrier, a reflection layer arranged on the second carrier, the resilient body comprising a plurality of supporters and a protrusion between two supporters, wherein the protrusion is corresponding to the metal dome;

a keypad layer comprising a first carrier attached to the second carrier, the first carrier comprising a keypad set with a plurality of keycaps, wherein a keycap surface has a smooth face and a supporting surface connecting the keycaps has a matted face because the keypad is manufactured with a first molding cavity with rugged bottom face and a second molding cavity with rugged bottom face.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1A:
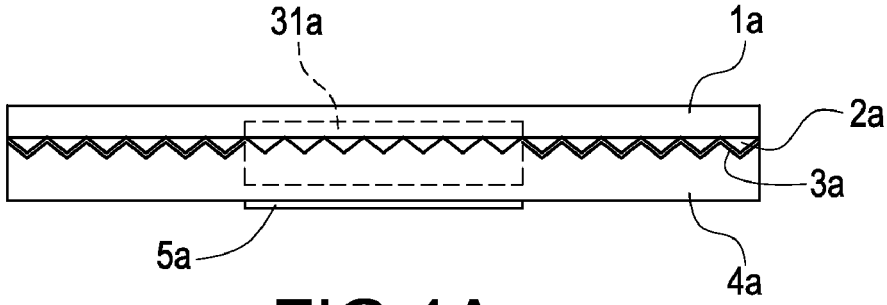
FIG.1A PRIOR ART
FIG. 1A shows a sectional view of a prior art patterned layer in keypad structure.
Figure 1B:
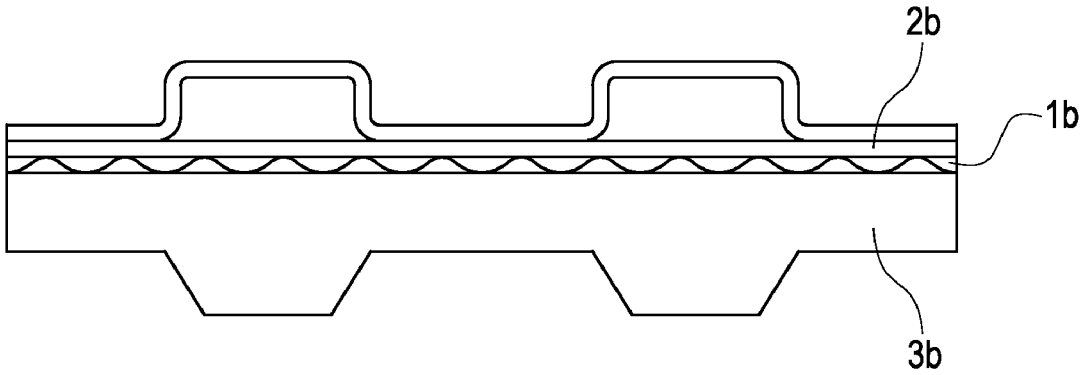
FIG.1B PRIOR ART
FIG. 1B shows a sectional view of another prior art patterned layer in keypad structure.
Figure 2A:
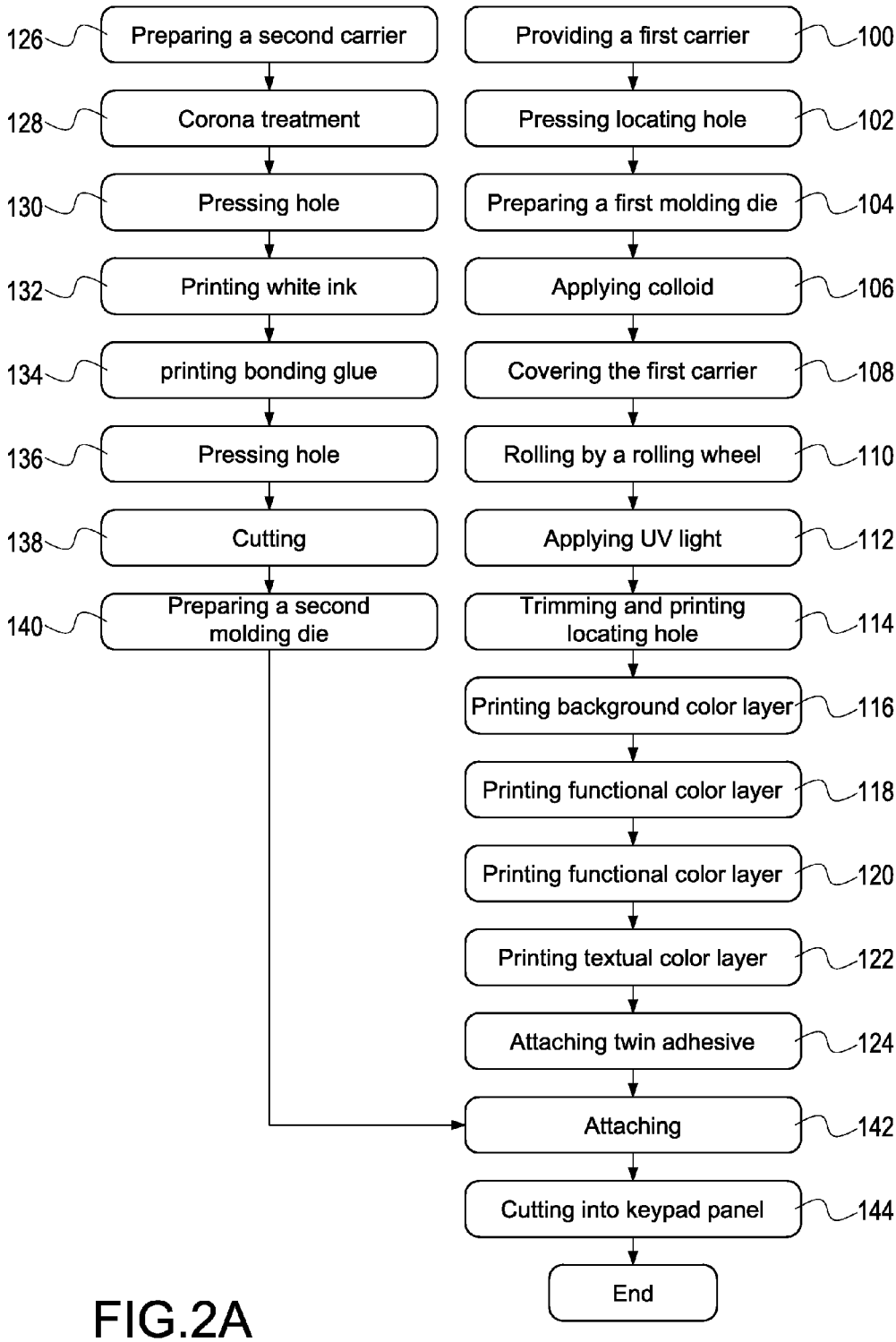
FIG. 2A shows the flowchart for manufacturing the compact keypad according to the first preferable embodiment of the present invention.

FIG. 2A shows the flowchart for manufacturing the compact keypad according to the first preferable embodiment of the present invention. The present invention provides a method for manufacturing a keypad with patterned layer. At step 100, a first carrier 2 made of transparent Polycarbonate film is prepared.

Figure 3:
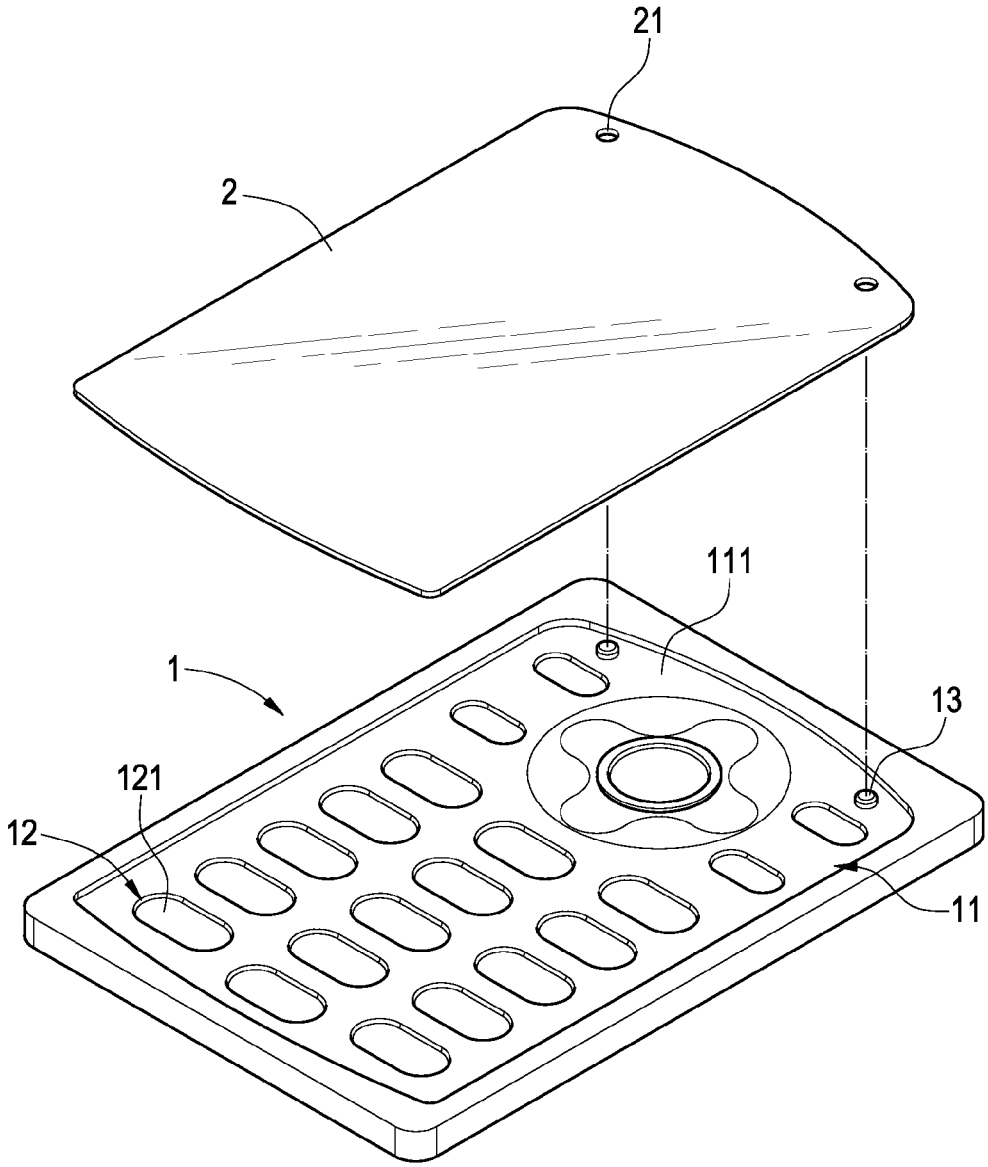
FIG. 3 shows the perspective view of the first carrier according to the present invention.

At step 102, with also reference to FIG. 3, locating hole 21 is pressed on the surface of the first carrier 2 and the locating hole 21 is used to clamp the carrier 2 to the guiding post 13 of the first molding die 1.

Figure 4:
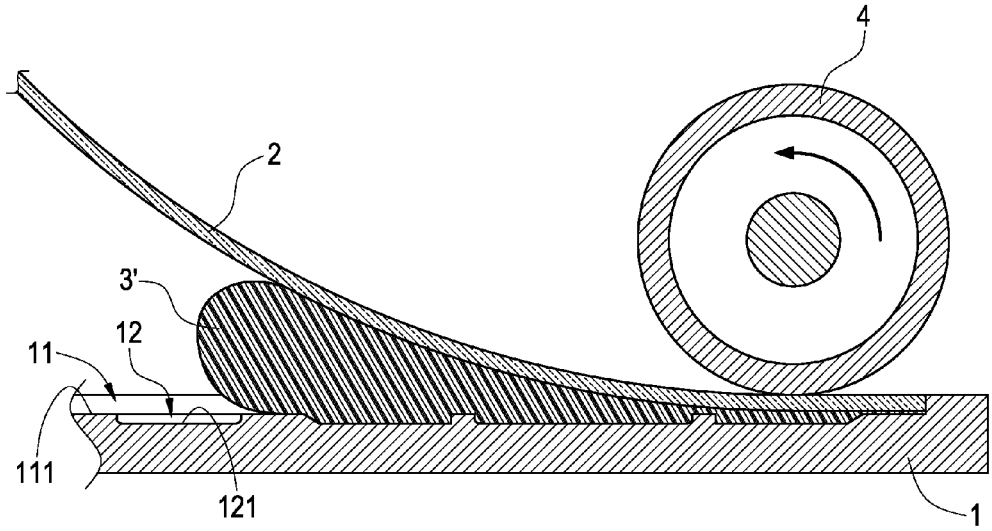
FIG. 4 shows the sectional view of a first molding die according to the first design of the present invention.

At step 104, with also reference to FIG. 4, a first molding die 1 is prepared with a first molding cavity 11 defined in the first molding die 1. The first molding cavity 11 further comprises a plurality of second molding cavities 12 with shapes corresponding to keycaps. The bottom face 111 of the first molding cavity 11 is a rugged face, and the bottom face 121 of the second molding cavity 12 is a smooth face.

At step 106, with also reference to FIG. 4, colloid 3' is applied to the first molding cavity 11 of the first molding die 1, where the colloid 3' is, for example, an ultraviolet curable resin.

At step 108, with also reference to FIG. 4, the first carrier 2 is placed to cover the colloid 3'.

Figure 5:
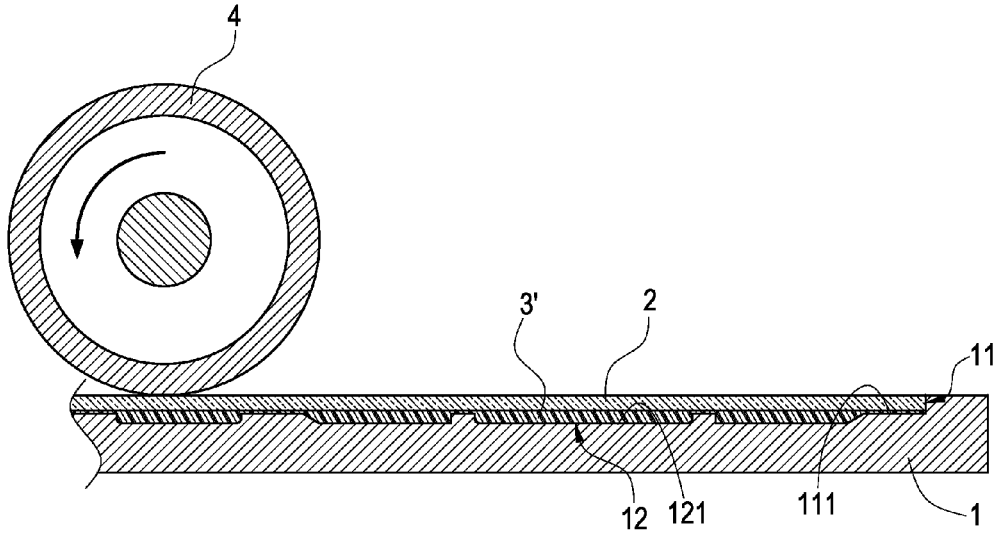
FIG. 5 shows the pressing operation by the first molding die shown in FIG. 4.

At step 110, with also reference to FIG. 5, a rolling wheel 4 is used to roll on the surface of the first carrier 2 such that the colloid 3' is filled into the first molding cavity 11 and the second molding cavity 12. Air among the colloid 3' and the first carrier 2, the first molding cavity 11 and the second molding cavity 12 is expelled outside to prevent air from remaining in the colloid 3'. Therefore, air bubble is not present in the colloid 3'.

At step 112, the rolled first molding cavity 11 is exposed to ultraviolet light to cure the colloid 3' made of ultraviolet curable resin and the colloid 3' is formed into a keypad layer 3.

At step 114, the first carrier 2 and the keypad layer 3 are removed from the first molding die 1 and then subjected to trimming and printed with locating hole.

Figure 6:
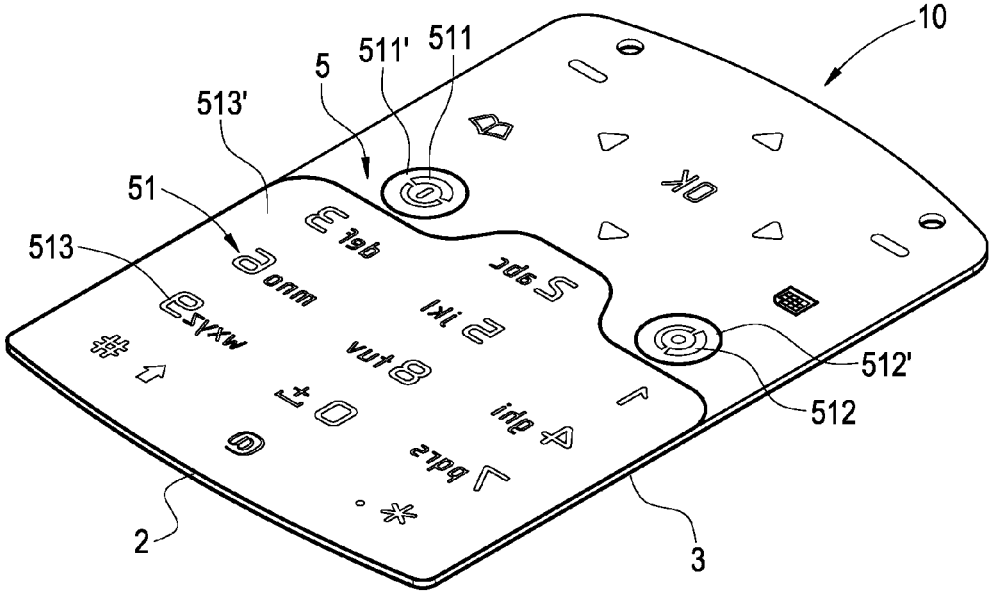
FIG. 6 shows the printing on backside of the keypad panel according to the present invention.

At step 116, with also reference to FIG. 6, black ink is printed on another face of the first carrier 2 to form a background color layer 5. Patterns 51 with the shapes of hollow letter, number or symbol are formed on the background color layer 5 and corresponding to the keycaps of the colloid 3'.

At step 118, with also reference to FIG. 6, a red ink is printed on the surface of the hollow End pattern 511 of background color layer 5 to form a functional color layer 511'.

At step 120, with also reference to FIG. 6, a green ink is printed on the surface of the hollow Dial pattern 512 of background color layer 5 to form another functional color layer 512'

At step 122, with also reference to FIG. 6, a white ink is printed on surface of the hollow text/number keys 513 of background color layer 5 to form a text color layer 513', where the hollow text/number keys 513 manifest white color.

Figure 7:
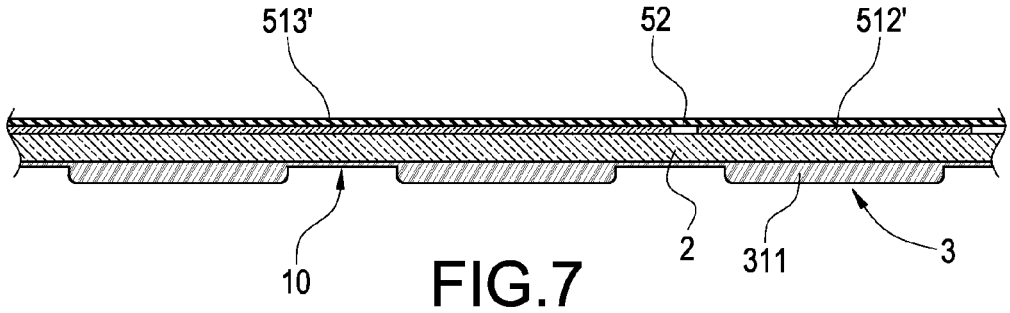
FIG. 7 is a sectional view for the keypad panel in FIG. 6.

At step 124, with also reference to FIGS. 6 and 7, a twin adhesive 52 is pasted to surfaces of the background color layer 5, the functional color layers 511' and 512', and the textual color layer 513', thus finishing the manufacture of keypad layer.

Figure 8:
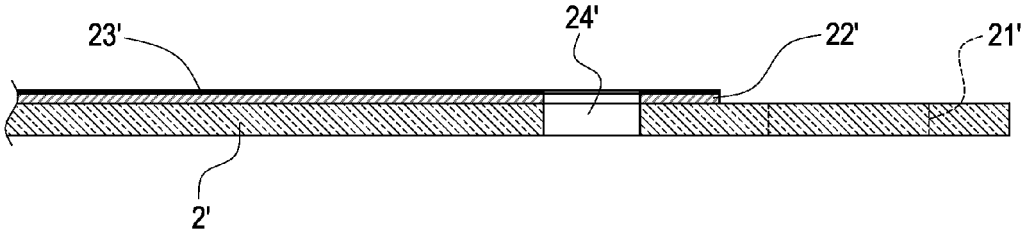
FIG. 8 shows the sectional view of the second carrier according to the present invention.

At step 126, with also reference to FIG. 8, a second carrier 2' is prepared, where the second carrier 2' is made of transparent Polyethylene Terephthalate Film material.

At step 128, with also reference to FIG. 8, the surface of the second carrier 2' is subjected to a corona treatment, which is an electrical-shock treatment to enhance adhesion property on surface of the second carrier 2'.

At step 130, with also reference to FIG. 8, locating hole 21' is pressed on the second carrier 2' to facilitate the clamping of the second carrier 2' on a printing machine.

At step 132, with also reference to FIG. 8, a reflection layer 22' with a white ink is printed to the surface of the second carrier 2'.

Figure 9:
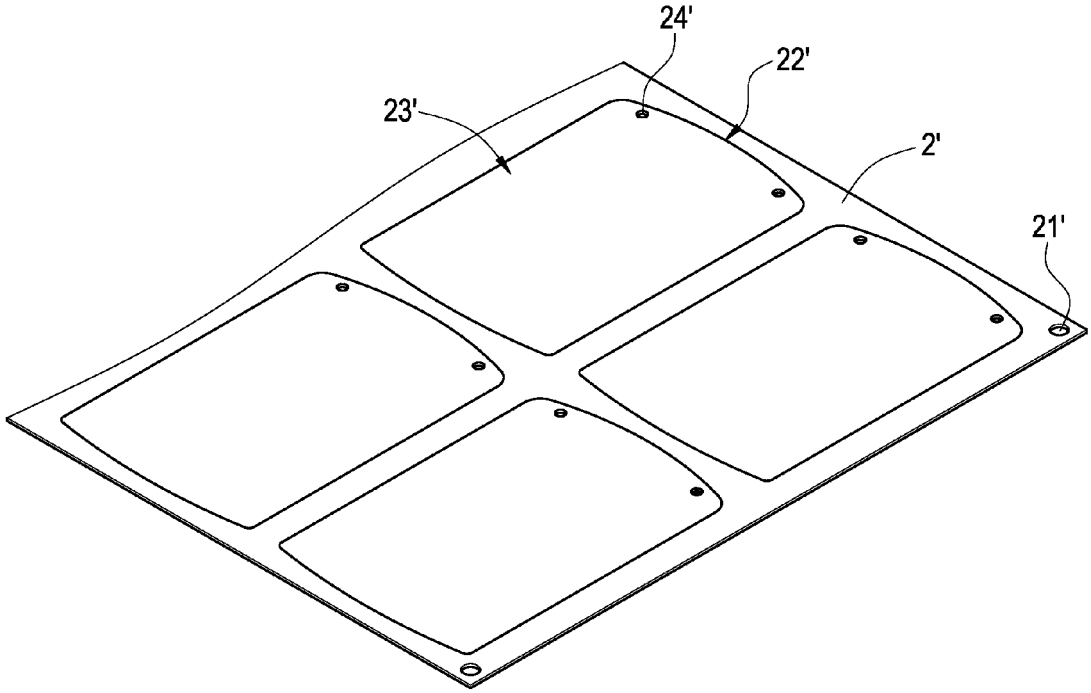
FIG. 9 shows the perspective view of the second carrier according to the present invention.

At step 134, with also reference to FIG. 9, a bonding glue 23' is printed on the surface of the reflection layer 22'.

At step 136, locating hole 24' is pressed on the second carrier 2' to facilitate the second carrier 2' to clamp to the second molding die 1'.

At step 138, the second carrier 2' is cut into shape corresponding to keypad panel.

Figure 10:
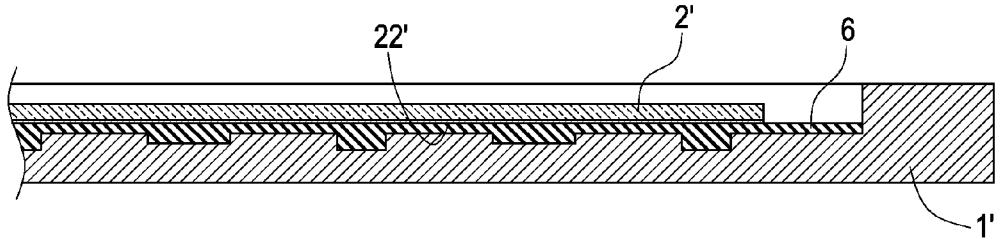
FIG. 10 shows that the keypad panel and the silicon rubber are placed into the second molding die.
Figure 11:
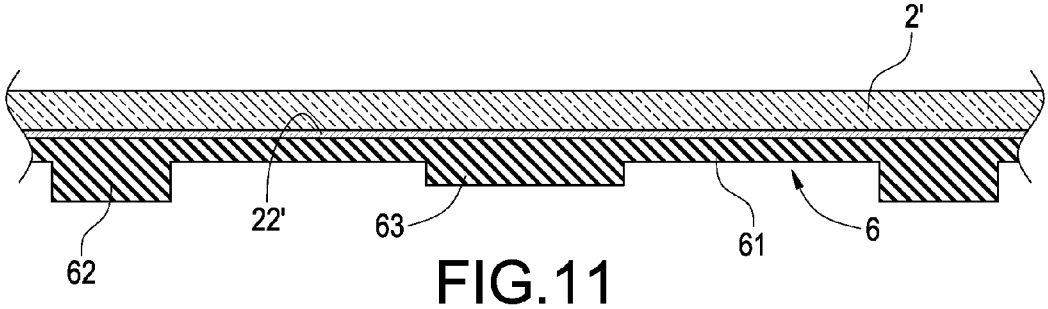
FIG. 11 is a sectional view showing the keypad panel assembled with the resilient layer.

At step 140, with also reference to FIGS. 10 and 11, the second carrier 2' and the silicon rubber 6' are placed into the second molding die 1'; and the second carrier 2' and silicon rubber 6' are combined by thermally pressing to form a resilient layer 6. A resilient body 61 is formed atop the resilient layer 6. Supporter 62 and protrusion 63 corresponding to a keycap are formed on the resilient body 61.

Figure 12:
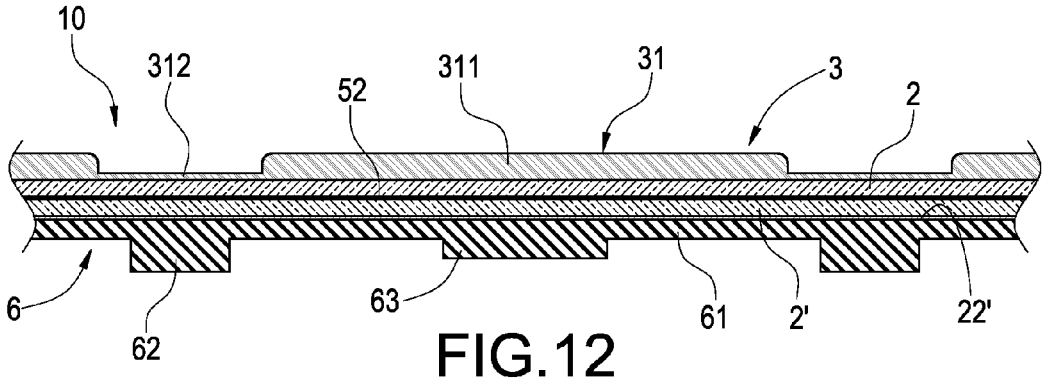
FIG. 12 is a sectional view showing the keypad panel assembled with the keypad layer

At step 142, with also reference to FIG. 12, the second carrier 2' on the resilient layer 6 is attached to the first carrier 1 on the keypad layer 3.

At step 144, the resulting structure is cut into shape of keypad panel.

Figure 2B:
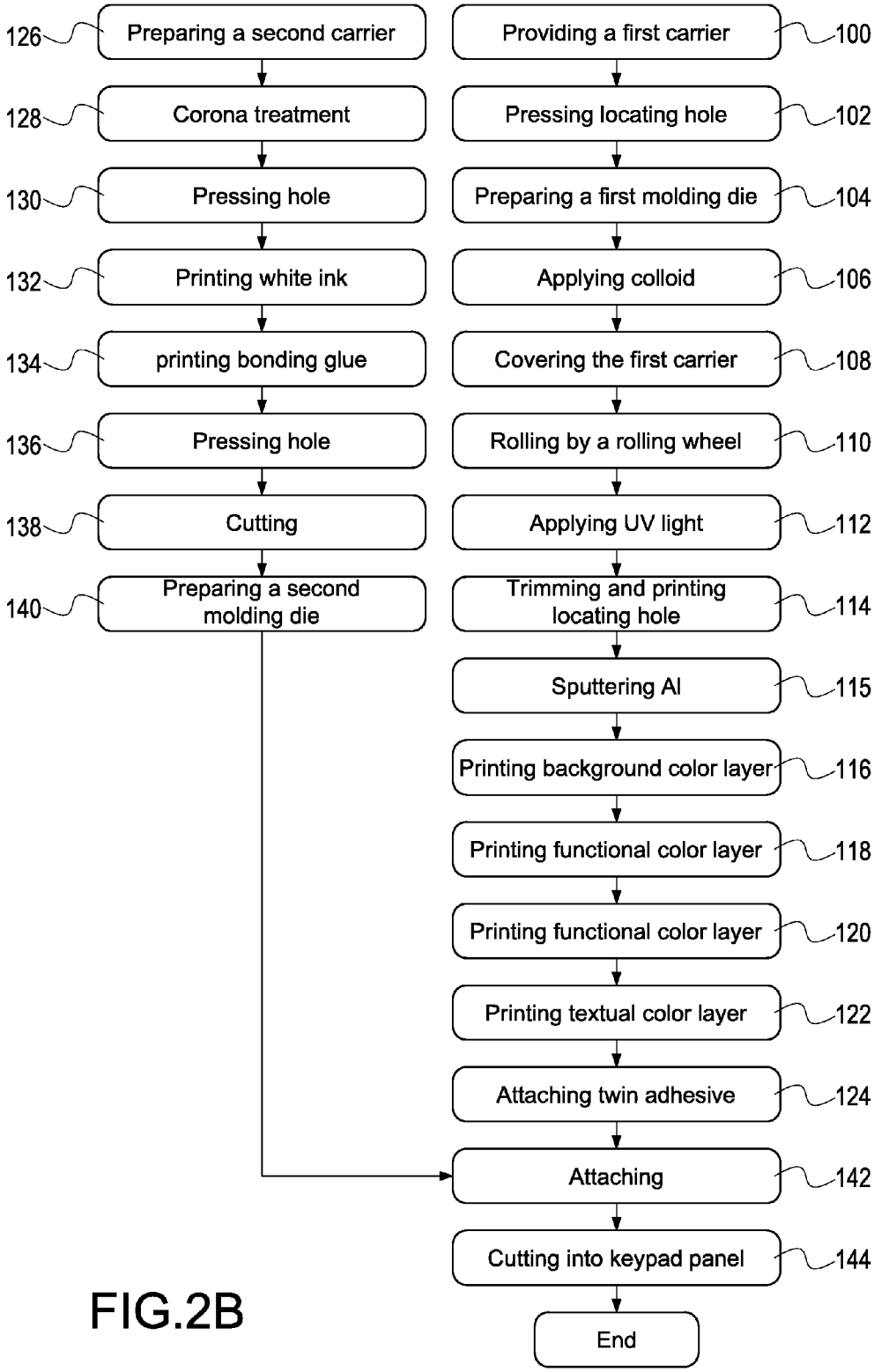
FIG. 2B shows the flowchart for manufacturing the compact keypad according to the second preferable embodiment of the present invention.

With reference to FIG. 2B, the process for the compact keypad according to the second preferred embodiment of the present invention is demonstrated. The steps shown in FIG. 2B are similar to those shown in FIG. 2A except that a step 115 is added between steps 114 and 116. At step 115, an aluminum layer with 40% light transmission ratio is sputtered on the back side of the first carrier 2 before printing the background color layer 5. Therefore, a metal-like effect is present on the resulting keypad panel.

Figure 13:
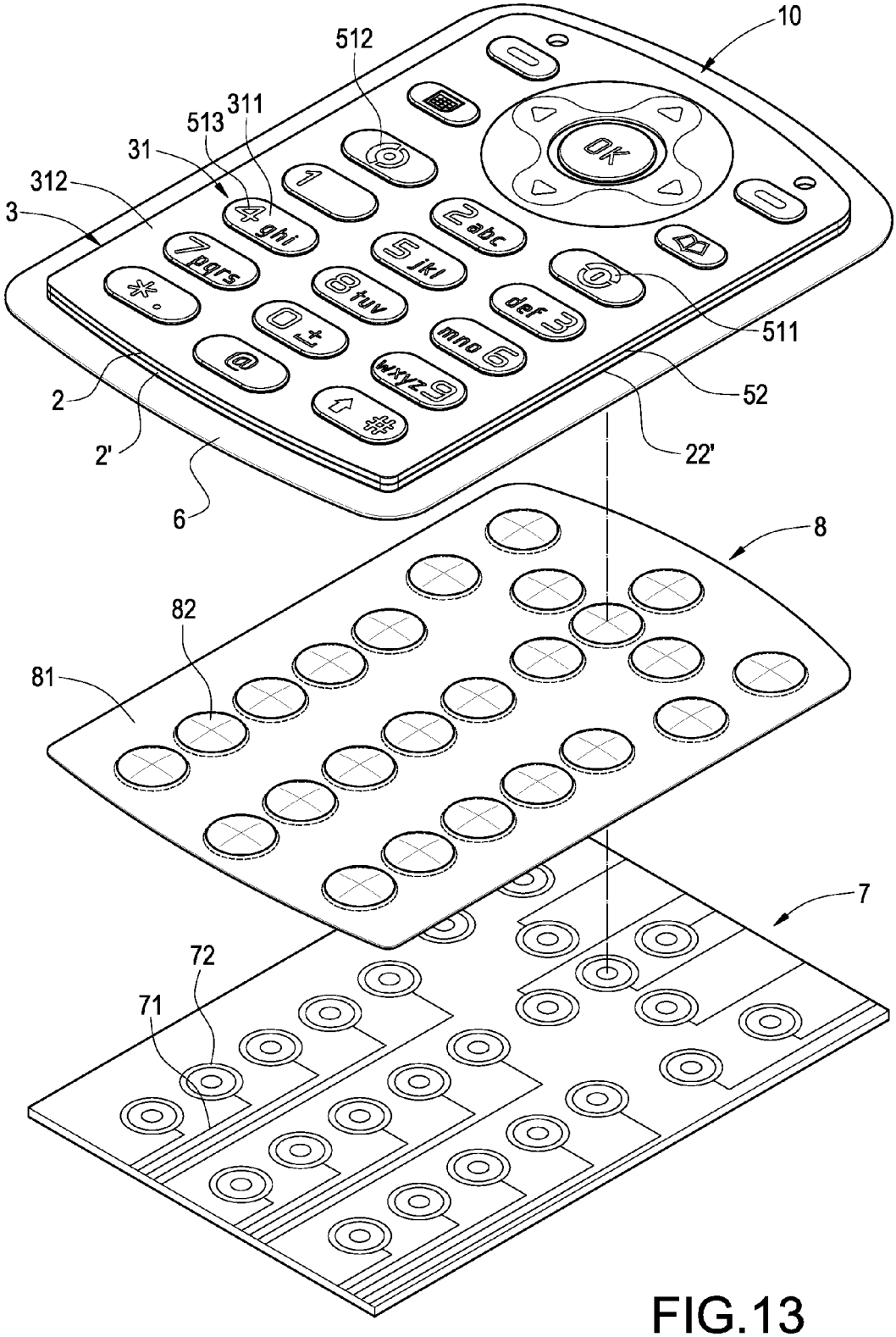
FIG. 13 shows the exploded view of the compact keypad structure of the present invention, where a flexible printed circuit board, an illumination layer, a resilient layer and a keypad panel are shown.

FIG. 13 shows the exploded view of the compact keypad of the present invention, where a flexible printed circuit board 7, an illumination layer 8, a resilient layer 6 and a keypad panel 3 are shown.

The flexible printed circuit board 7 is a thin-film printed circuit board formed with circuit traces 71 and contacts 72.

The illumination layer 8 is an illumination plate 81 on the flexible printed circuit board 7. The illumination plate 81 is, for example, an electroluminescent panel according to the preferred embodiment of the present invention. A plurality of metal domes 82 is provided on another face of the illumination plate 81, where the metal domes 82 are corresponding to the contacts 72 of the flexible printed circuit board 7.

Figure 14:
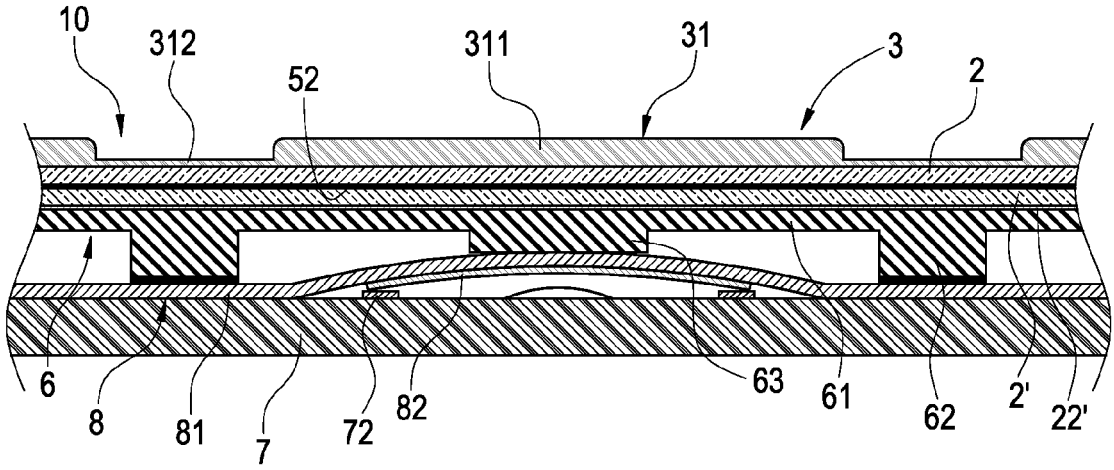
FIG. 14 shows a section view for the keypad shown in FIG. 13.

With reference to FIG. 14, the resilient layer 6 is placed on the illumination layer 8 and comprises a second carrier 2' and a resilient body 61 on the second carrier 2'. The second carrier 2' comprises a reflection layer 22' and the resilient body 61 comprises a plurality of supporters 62. A protrusion 63 is formed between the supporters 62 and corresponding to the metal dome 82.

The keypad layer 3 comprises a first carrier 2 attached with the second carrier 2'. The first carrier 2 comprises a keypad set 31, where the keypad set 31 comprises a plurality of keycaps 311. The bottom face 111 of the first molding cavity 11 is a rugged face and the bottom face 121 of the second molding cavity 12 is a smooth face. Therefore, the face of the finished keycap 311 is smooth face, while the supporting face 312 between the keycaps 311 is a matted face.

Figure 15:
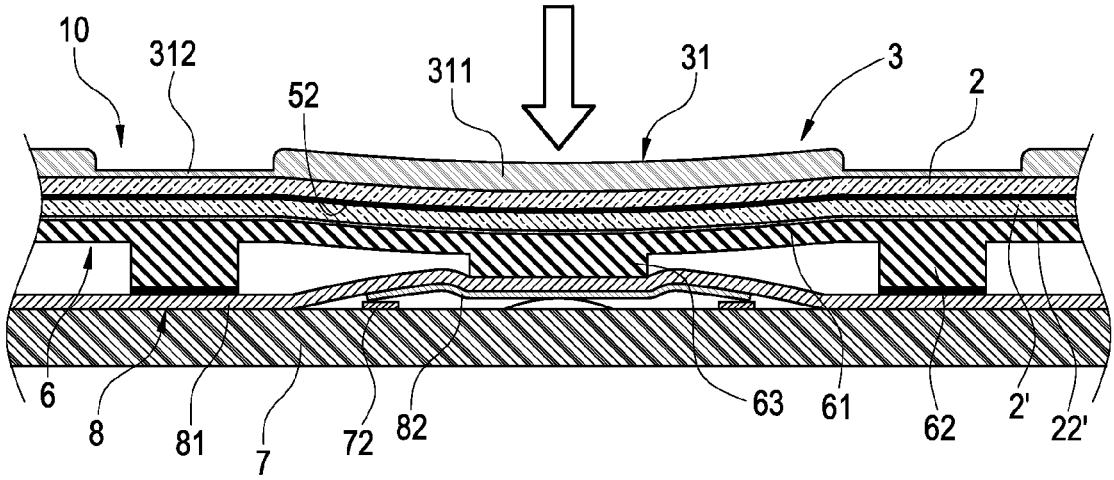
FIG. 15 shows a key-pressing operation for the keypad shown in FIG. 14.

FIG. 14 shows a section view for the keypad shown in FIG. 13. FIG. 15 shows a key-pressing operation for the keypad shown in FIG. 14. The surface light generated by the illumination plate 81 of the illumination layer 8 is directly impinged on the bottom of the resilient body 61. The light then passes the resilient body 61, the second carrier 2' and the first carrier 2 such that the keycap 311 on the keypad panel 3 has light transparent effect.

When user exerts force on the keycap 311, the resilient body 61, the second carrier 2' and the first carrier 2 are deformed and the protrusion 63 presses against the surface of the light illumination plate 81 to generate an operation signal.

Figure 16:
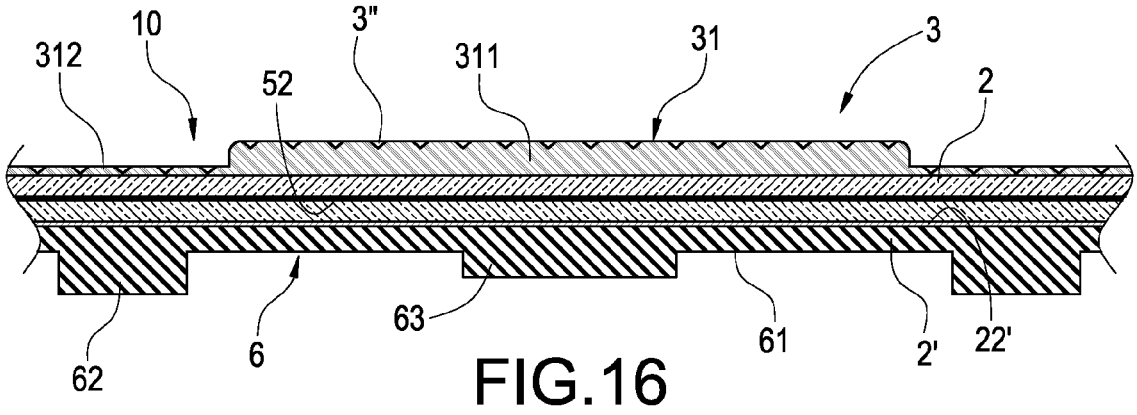
FIG. 16 shows the sectional view demonstrating the pattern of the keypad panel of the present invention.
Figure 17:
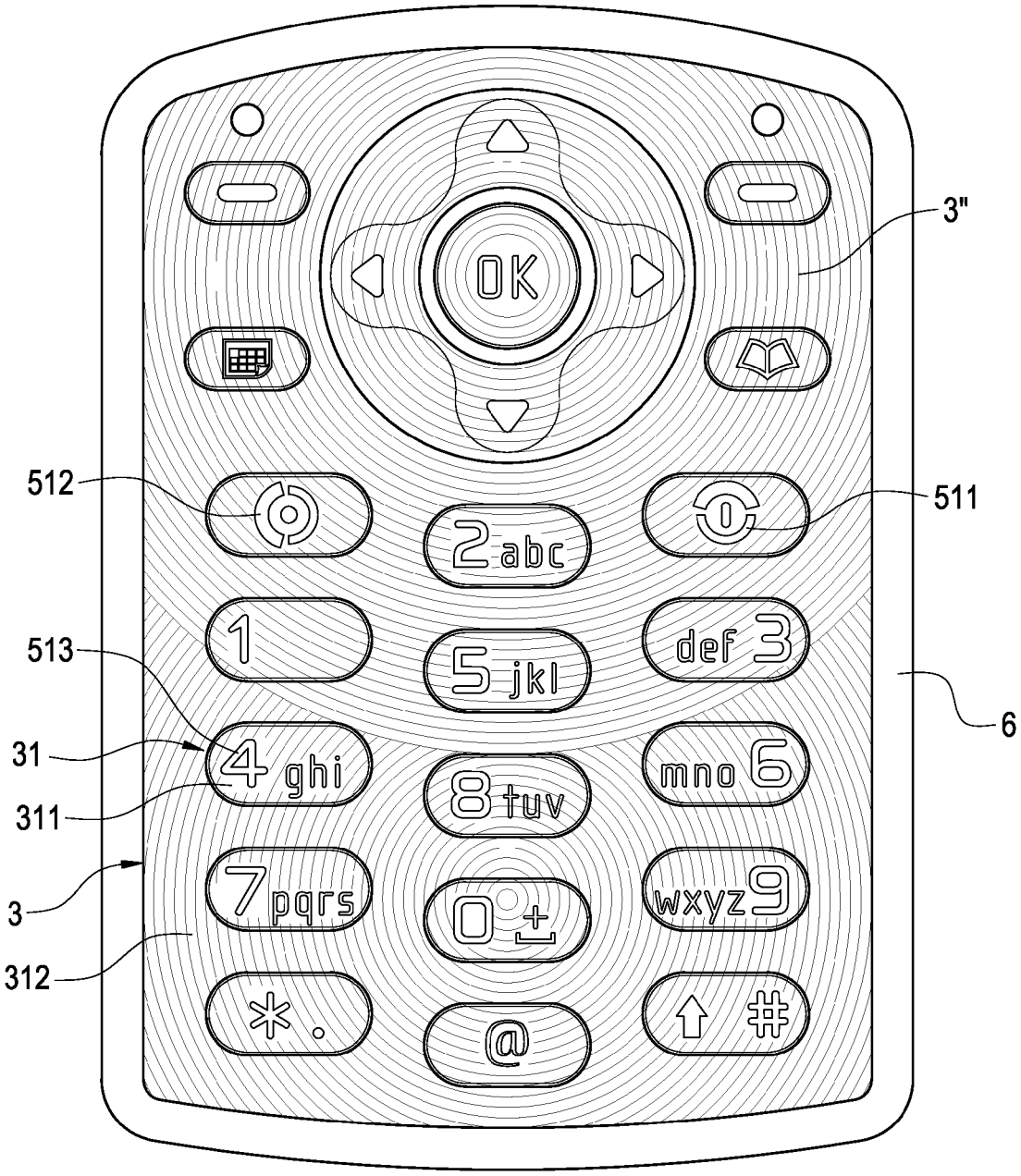
FIG. 17 shows the top view demonstrating the pattern of the keypad panel of the present invention.
Figure 18:
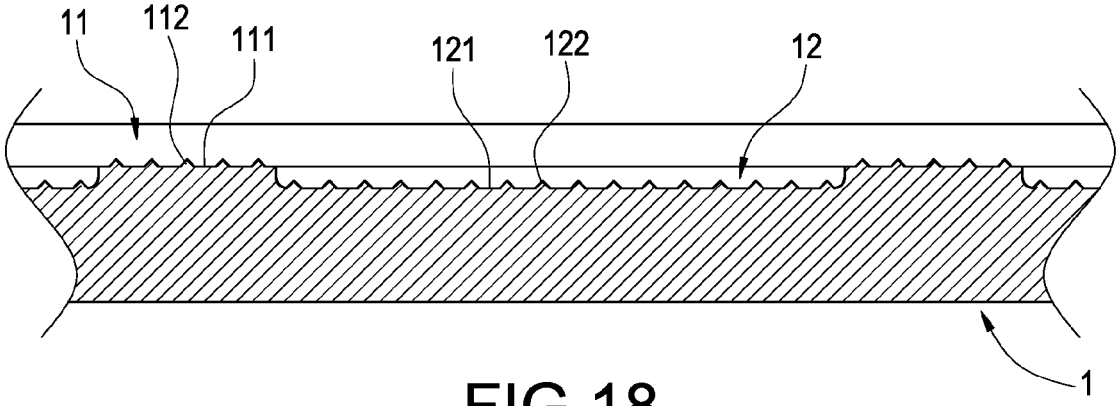
FIG. 18 shows a partially-enlarged view of the first molding cavity according to the second design of the present invention.

FIG. 16 shows the sectional view demonstrating the pattern of the keypad of the present invention. FIG. 17 shows the top view demonstrating the pattern of the keypad of the present invention. FIG. 18 shows a partially-enlarged view of the first molding cavity according to the second design of the present invention. When the bottom face 111 of the first molding cavity 11 and the bottom face 121 of the second molding cavity 12 are provided with patterns 112 and 122, respectively, the keycap 311 and the supporting face 312 of the finished keypad panel 3 also have pattern layer 3". In the shown figure, the pattern layer 3" is one of spinning pattern, strip pattern and Archimedean screw pattern.

Figure 19:
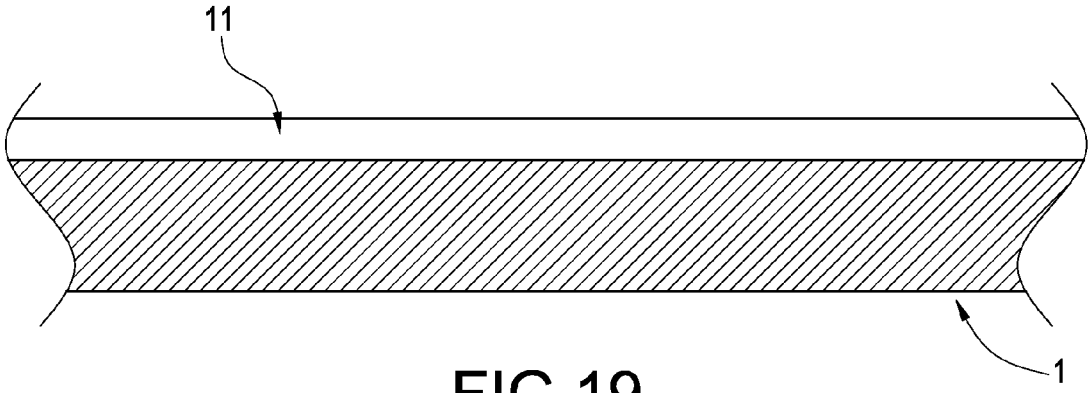
FIG. 19 shows a partially enlarged view of the first molding cavity according to the third design of the present invention.
Figure 20:
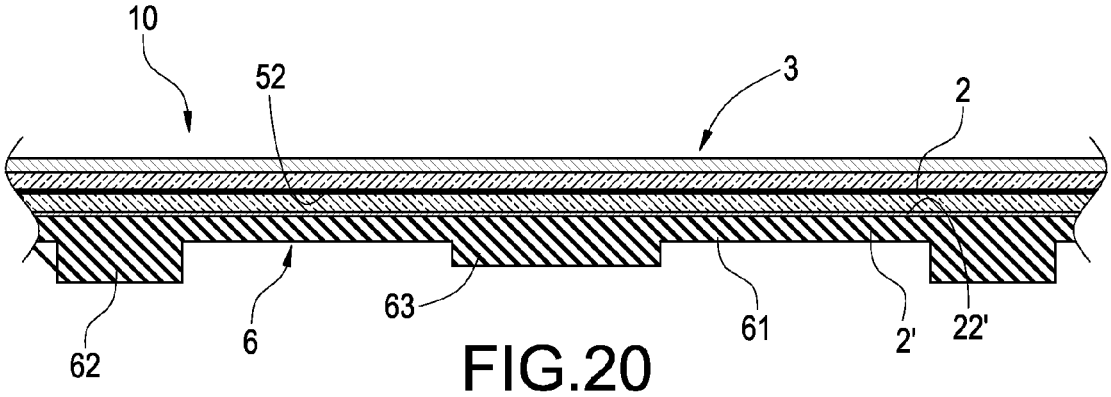
FIG. 20 shows the sectional view of the finished keypad panel made with the first molding cavity shown in FIG. 19.

FIG. 19 shows a partially enlarged view of the first molding cavity according to the third design of the present invention. FIG. 20 shows the sectional view of the finished keypad made with the first molding cavity shown in FIG. 19. As shown in this figure, when the second molding cavity 12 is absent from the first molding cavity 11, the keycap 311 does not project from the surface of the keypad panel 3 after the keypad panel 3 is finished. Therefore, the keypad panel 3 has a flat surface.

Figure 21:
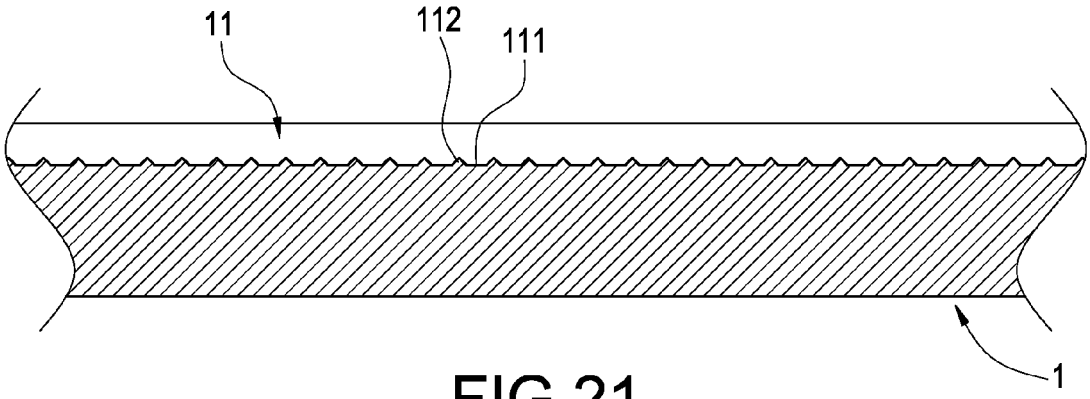
FIG. 21 shows a partially enlarged view of the first molding cavity according to the fourth design of the present invention.
Figure 22:
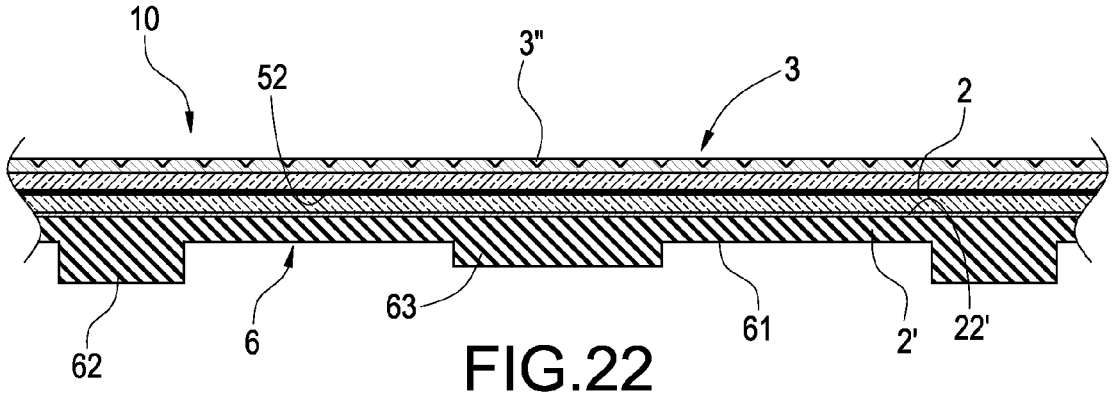
FIG. 22 shows the sectional view of the finished keypad panel made with the first molding cavity shown in FIG. 21.

FIG. 21 shows a partially enlarged view of the first molding cavity according to the fourth design of the present invention. FIG. 22 shows the sectional view of the finished keypad made with the first molding cavity shown in FIG. 21. When pattern 112 is formed on the bottom face 111 of the first molding cavity 11, a pattern layer 3" is also formed on the whole surface of the keypad panel 3 after the keypad panel 3 is finished. In the shown figure, the pattern layer 3" can be one of spinning pattern, strip pattern and Archimedean screw pattern.

Figure 23:
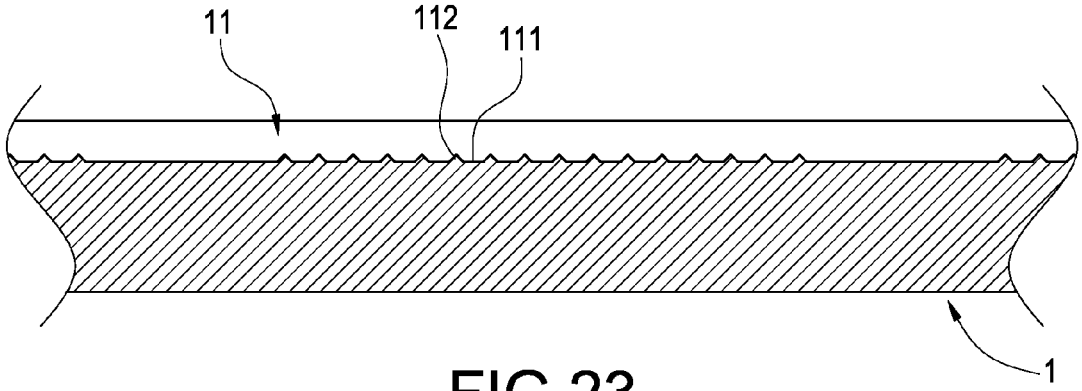
FIG. 23 shows a partially enlarged view of the first molding cavity according to the fifth design of the present invention.
Figure 24:
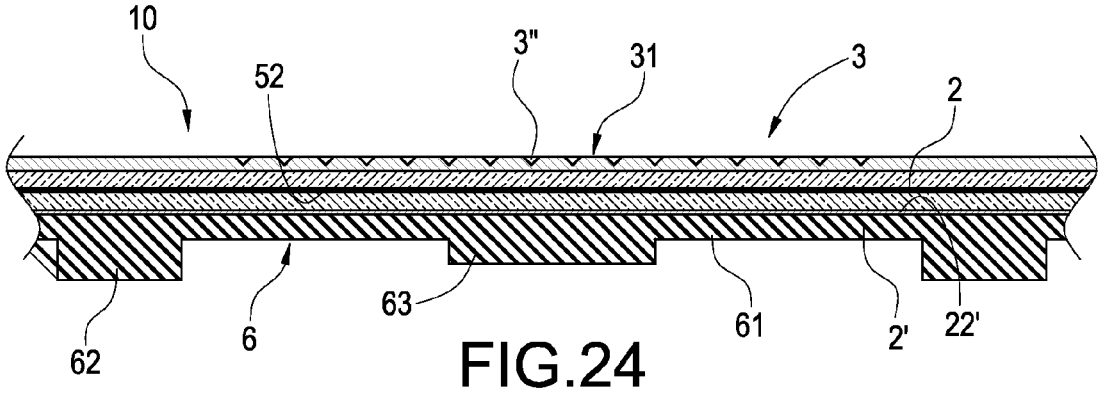
FIG. 24 shows the sectional view of the finished keypad panel made with the first molding cavity shown in FIG. 23.

FIG. 23 shows a partially enlarged view of the first molding cavity according to the fifth design of the present invention. FIG. 24 shows the sectional view of the finished keypad made with the first molding cavity shown in FIG. 23. When pattern 112 is formed on the bottom face 111 of the first molding cavity 11 and corresponding to the position of keycap 311, a pattern layer 3" is also formed on the surface of the planar keycap 311 of the keypad panel 3 after the keypad panel 3 is finished. In the shown figure, the pattern layer 3" can be one of spinning pattern, strip pattern and Archimedean screw pattern.

Figure 25:
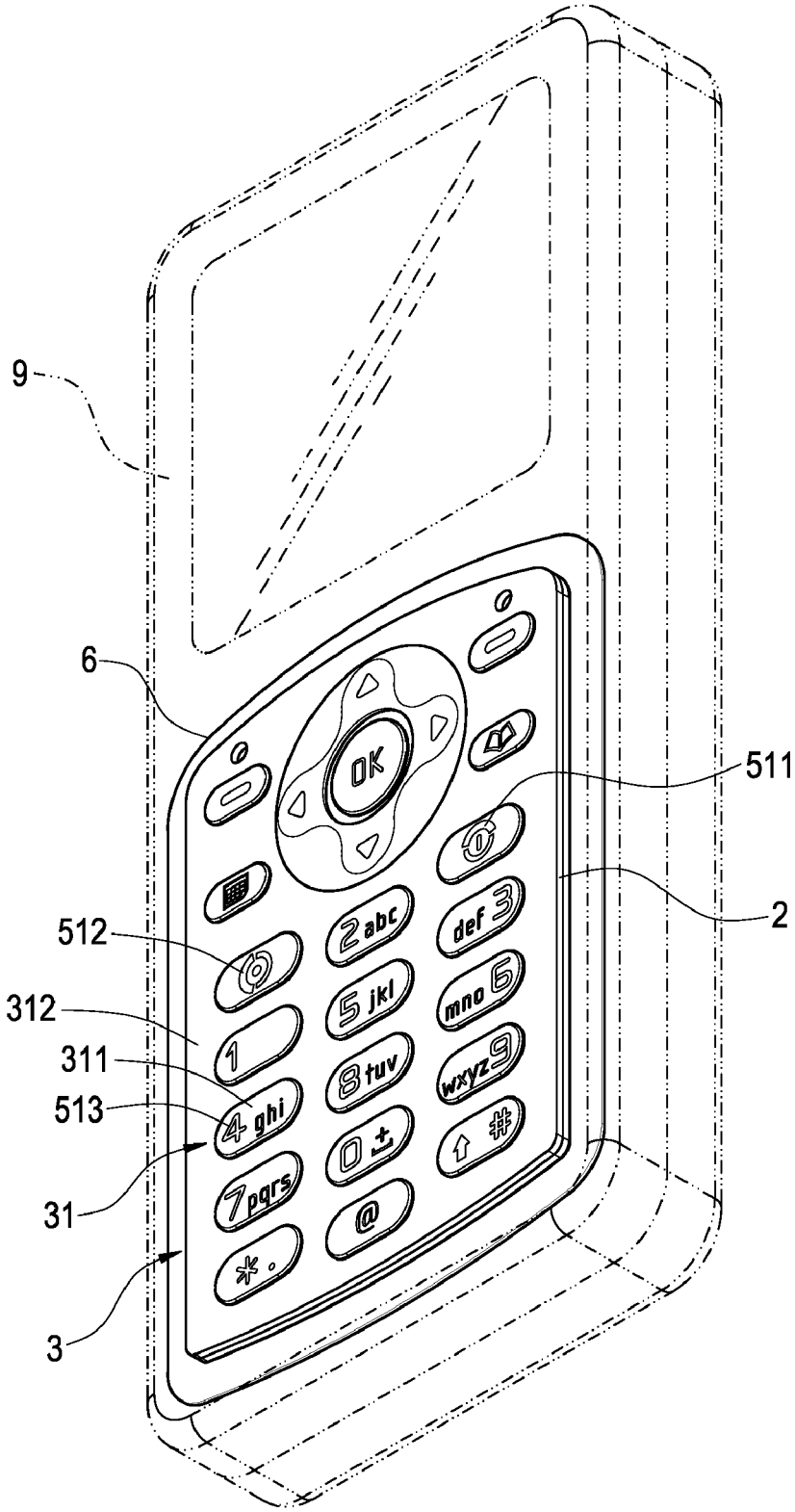
FIG. 25 is a schematic drawing showing the keypad panel of the present invention in use for a mobile phone.

FIG. 25 is a schematic drawing showing the keypad of the present invention in use for a mobile phone. When the keypad of the present invention is used for a mobile phone 9, the surface light source in the keypad directly illuminates the keypad panel 3, whereby the keycap 311 of the keypad panel 3 has transparent effect.

Figure 26:
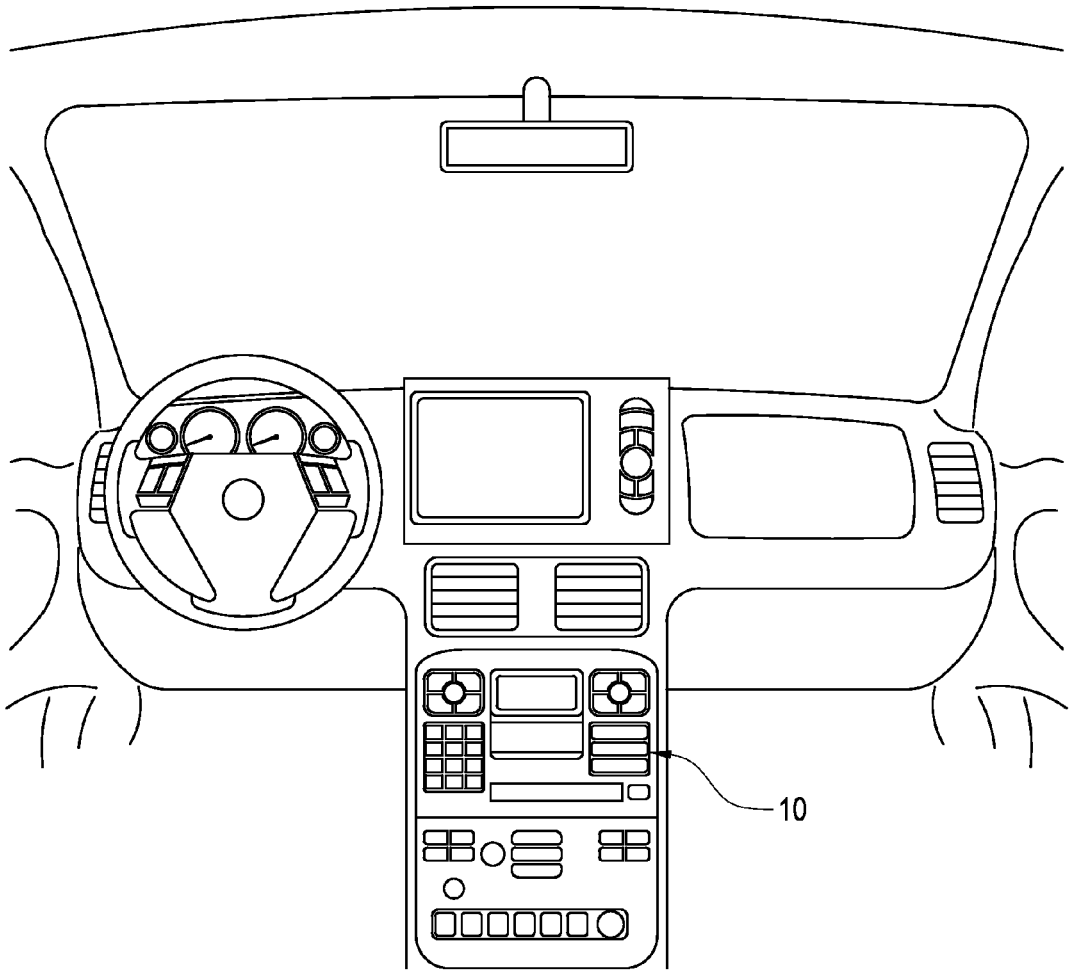
FIG. 26 is a schematic drawing showing the keypad structure of the present invention in use for a panel of audio equipment of a vehicle.

FIG. 26 is a schematic drawing showing the keypad of the present invention in use for a panel of audio equipment of a vehicle. The keypad of the present invention can be used for panel 10 of audio equipment of a vehicle to control the air condition, the audio-video system and satellite navigation for the vehicle beside the application for mobile phone.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A compact keypad structure comprising:

a resilient body comprising a plurality of supporters and a protrusion between two supporters;

a second carrier arranged on the resilient body and comprising a reflection layer on a face attached to the resilient body;

a first carrier arranged on the second carrier;

a background color layer formed on the first carrier, a functional color layer arranged on the background color layer, and a textual color layer arranged on the background color layer; and a keypad layer arranged on a surface of the first carrier and comprising a patterned layer.

2. The compact keypad structure as in claim 1, wherein the resilient body is a silicon rubber.

3. The compact keypad structure as in claim 1, wherein the first carrier is made of transparent polycarbonate film and the second carrier is made of transparent polyethylene terephthalate film.

4. The compact keypad structure as in claim 1, wherein the background color layer is made of black ink and comprises patterns of hollow text, numbers or symbols.

5. The compact keypad structure as in claim 1, wherein the functional color layer is provided on a pattern of a dial key.

6. The compact keypad structure as in claim 1, wherein the functional color layer is provided on a pattern of an end key.

7. The compact keypad structure as in claim 4, wherein the textual color layer is arranged on the patterns of hollow text, numbers or symbols.

8. The compact keypad structure as in claim 1, wherein the patterned layer is a spinning pattern.

9. The compact keypad structure as in claim 1, wherein the keypad layer comprises a supporting face on the first carrier and a plurality of keycaps protruding on the supporting face, wherein the supporting face and the keycaps comprise the patterned layer.

10. The compact keypad structure as in claim 9, wherein the patterned layer is a spinning pattern.

11. The compact keypad structure as in claim 1, wherein the keypad layer comprises a patterned layer corresponding to the position of the keypad.

12. The compact keypad structure as in claim 11, wherein the patterned layer is a spinning pattern.

13. The compact keypad structure as in claim 1, wherein an illumination layer is provided below the resilient body and comprises an illumination plate, a plurality of metal domes is provided on another face of the illumination plate and corresponds to the protrusions.

14. The compact keypad structure as in claim 13, wherein the illumination plate is an electroluminescent panel.

15. The compact keypad structure as in claim 13, wherein a flexible printed circuit board is arranged below the illumination layer.

* * * * *